US012637789B2

(12) United States Patent
Lee et al.

(10) Patent No.: US 12,637,789 B2
(45) Date of Patent: May 26, 2026

(54) POLYETHYLENE YARN OF HIGH TENACITY HAVING HIGH DIMENSIONAL STABILITY AND METHOD FOR MANUFACTURING THE SAME

(71) Applicant: KOLON INDUSTRIES, INC., Seoul (KR)

(72) Inventors: Sin-Ho Lee, Seoul (KR); Il Chung, Seoul (KR); Young-Soo Lee, Seoul (KR); Min-Woo Nam, Seoul (KR)

(73) Assignee: KOLON INDUSTRIES, INC., Seoul (KR)

( * ) Notice: Subject to any disclaimer, the term of this patent is extended or adjusted under 35 U.S.C. 154(b) by 249 days.

(21) Appl. No.: 17/763,206

(22) PCT Filed: Dec. 15, 2020

(86) PCT No.: PCT/KR2020/018366
§ 371 (c)(1),
(2) Date: Mar. 24, 2022

(87) PCT Pub. No.: WO2021/132972
PCT Pub. Date: Jul. 1, 2021

(65) Prior Publication Data

US 2022/0364273 A1 Nov. 17, 2022

(30) Foreign Application Priority Data

Dec. 27, 2019 (KR) ..... 10-2019-0176422
Dec. 27, 2019 (KR) ..... 10-2020-0134422

(51) Int. Cl.
*D01F 6/04* (2006.01)
*D01D 5/088* (2006.01)

(52) U.S. Cl.
CPC ..... *D01F 6/04* (2013.01); *D01D 5/088* (2013.01); *D10B 2321/021* (2013.01)

(58) Field of Classification Search
None
See application file for complete search history.

(56) References Cited

U.S. PATENT DOCUMENTS 4,228,118 A 10/1980 Wu
4,483,727 A 11/1984 Eickman
5,505,900 A * 4/1996 Suwanda ..... B29C 71/04 264/495

(Continued)

FOREIGN PATENT DOCUMENTS

CN 103119208 A 5/2013
CN 103788445 * 5/2014

(Continued)

OTHER PUBLICATIONS

Machine translation of CN103788445 (Year: 2014).*

(Continued)

*Primary Examiner* — Shawn Mckinnon
(74) *Attorney, Agent, or Firm* — Harvest IP Law, LLP

(57) ABSTRACT

The present disclosure relates to a polyethylene yarn and a method for manufacturing the same. In the present disclosure, there are provided a polyethylene yarn having excellent dimensional stability and high tenacity, and a method for manufacturing the above polyethylene yarn more efficiently.

5 Claims, 3 Drawing Sheets

(56) References Cited

U.S. PATENT DOCUMENTS

| | | | | | |
|---|---|---|---|---|---|
| 5,578,374 | A * | 11/1996 | Dunbar | D01F 6/04 | 428/394 |
| 5,736,244 | A * | 4/1998 | Kavesh | D07B 1/025 | 428/394 |
| 6,448,359 | B1 * | 9/2002 | Kavesh | D01F 6/04 | 525/55 |
| 7,056,579 | B2 | 6/2006 | Sakamoto | | |
| 2003/0033655 | A1 | 2/2003 | Kavesh | | |
| 2005/0118418 | A1 | 6/2005 | Sakamoto | | |
| 2006/0035078 | A1 | 2/2006 | Tam | | |
| 2014/0000007 | A1 | 1/2014 | Fukushima | | |

FOREIGN PATENT DOCUMENTS

| | | | |
|---|---|---|---|
| EP | 3922765 | A1 | 12/2021 |
| JP | H08504891 | A | 5/1996 |
| JP | 2001514707 | A | 9/2001 |
| JP | 2011168926 | A | 9/2011 |
| JP | 2016532021 | A | 10/2016 |
| JP | 2020514569 | A | 5/2020 |
| KR | 890002110 | A | 4/1989 |
| KR | 890002110 | B1 | 6/1989 |
| KR | 1020130117872 | A | 10/2013 |
| KR | 2016-0059653 | A | 5/2016 |
| KR | 101838499 | B1 | 3/2018 |
| KR | 2018-0120373 | A | 11/2018 |
| KR | 1020180120373 | A | 11/2018 |
| KR | 101981759 | B1 | 5/2019 |
| KR | 2019-0096410 | A | 8/2019 |
| KR | 1020190096410 | A | 8/2019 |
| KR | 102178645 | B1 | 11/2020 |
| TW | 200712270 | A | 4/2007 |
| WO | 2007083510 | A1 | 7/2007 |
| WO | 2012117596 | A1 | 9/2012 |
| WO | 2018199397 | A1 | 11/2018 |
| WO | WO2018199397 | * | 11/2018 |

OTHER PUBLICATIONS

Machine Translation of WO2018199397 (Year: 2018).*
International Search Report dated Apr. 1, 2021.
TW search report.

* cited by examiner

【FIG. 1】
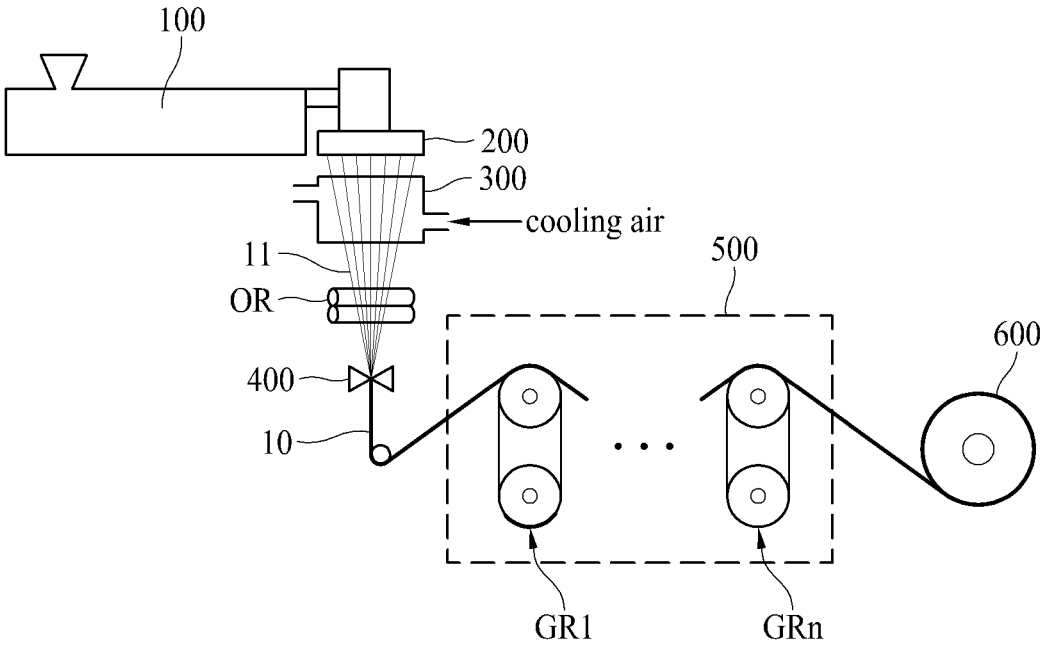
【FIG. 2】
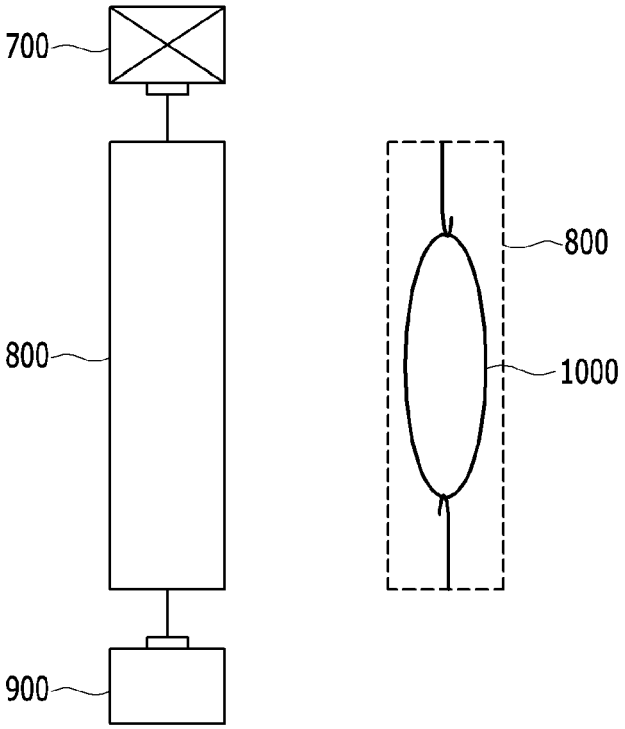

【FIG. 3】
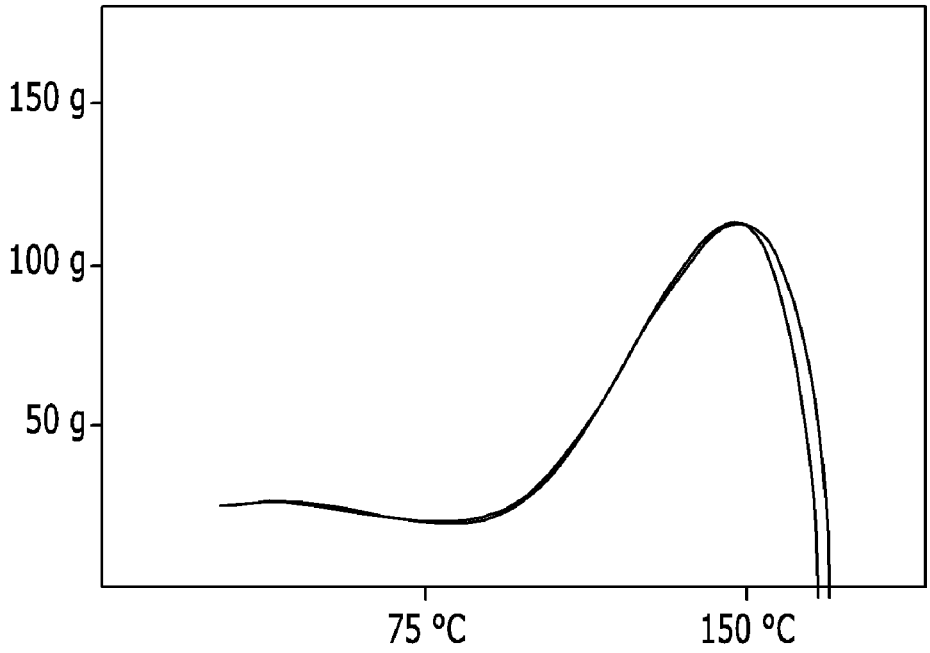
【FIG. 4】
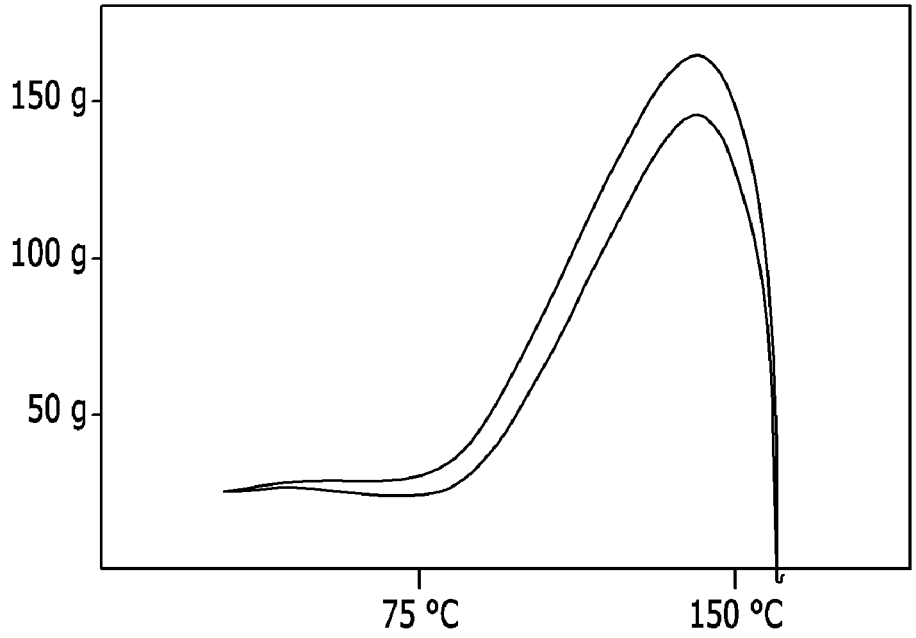

【FIG. 5】
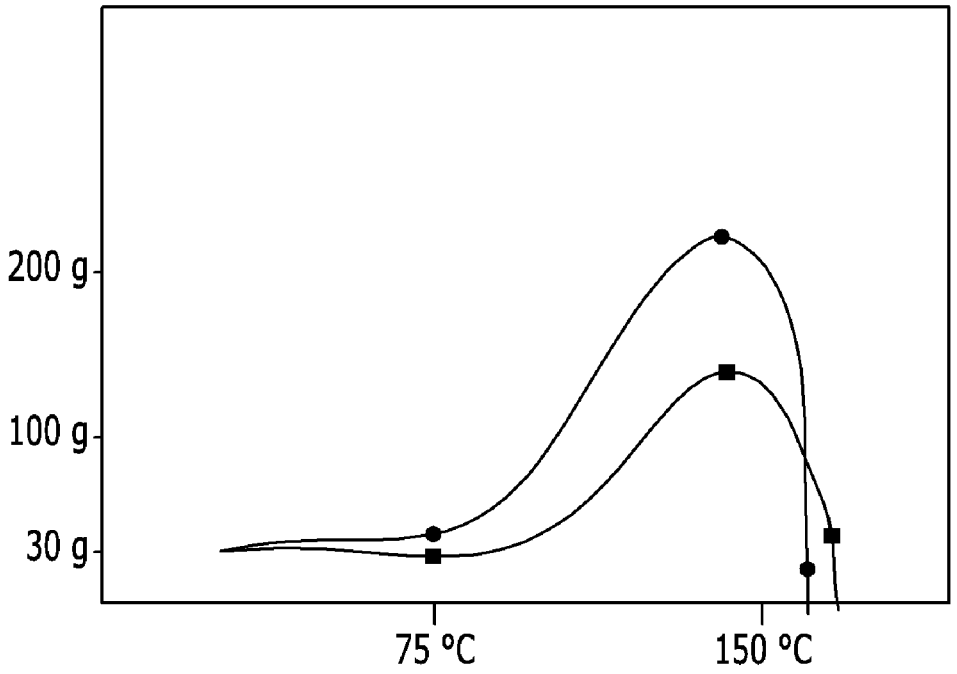

POLYETHYLENE YARN OF HIGH TENACITY HAVING HIGH DIMENSIONAL STABILITY AND METHOD FOR MANUFACTURING THE SAME

CROSS REFERENCE TO RELATED APPLICATION(S)

This application is a National Stage of International Application No. PCT/KR2020/018366 filed Dec. 15, 2020, claiming priority to Korean Patent Application No. 10-2019-0176422 filed Dec. 27, 2019 and Korean Patent Application No. 10-2020-0134422 filed Oct. 16, 2020, the disclosures of which is incorporated herein by reference in its entirety.

TECHNICAL FIELD

The present disclosure relates to a polyethylene yarn and a method for manufacturing the same.

BACKGROUND OF ART

Polyethylene yarns with high tenacity can be classified into an ultrahigh molecular weight polyethylene (hereinafter referred to as 'UHMWPE') yarn and a high molecular weight polyethylene (hereinafter referred to as 'HMWPE') yarn.

The UHMWPE generally refers to a linear polyethylene having a weight average molecular weight (Mw) of greater than 600,000 g/mol. The HMWPE generally refers to a linear polyethylene having a weight average molecular weight (Mw) of 20,000 to 600,000 g/mol.

It is known that the UHMWPE yarn can be manufactured only by a gel spinning method due to its high melt viscosity.

For example, a UHMWPE solution is prepared by polymerizing ethylene in an organic solvent in the presence of a catalyst, and subjected it to spinning and quenching to form a fibrous gel. Thereafter, the fibrous gel is drawn to obtain a polyethylene yarn with high tenacity and high modulus.

However, since the gel spinning method requires the use of an organic solvent, not only is an environmental problem caused, but also enormous cost is required to recover the organic solvent.

Since the HMWPE has a relatively low melt viscosity compared to the UHMWPE, it can be manufactured into a yarn by melt spinning.

However, the HMWPE has a limitation in that the tenacity of the yarn is inevitably low due to a relatively low molecular weight.

In order to overcome this limitation (that is, to improve the tenacity of the polyethylene yarn manufactured by melt spinning), prior arts such as U.S. Pat. No. 4,228,118 propose to apply a method of manufacturing an undrawn yarn by melt spinning polyethylene, and then drawing the undrawn yarn at a high draw ratio of about 20 times or more under high temperatures (so-called "two-step method"). A polyethylene yarn having tenacity of 13 g/d or more can be manufactured by such a two-step method.

However, the two-step method causes a decrease in productivity of the polyethylene yarn and an increase in manufacturing cost. In addition, the polyethylene yarn manufactured by the two-step method has insufficient dimensional stability.

DETAILED DESCRIPTION OF THE INVENTION

Technical Problem

In the present disclosure, there is provided a polyethylene yarn having excellent dimensional stability and high tenacity.

In addition, there is provided a method for manufacturing the above polyethylene yarn more efficiently.

Technical Solution

According to an embodiment of the present disclosure, there is provided a polyethylene yarn including 40 to 500 filaments having fineness of 10 denier or less, wherein the polyethylene yarn has total fineness of 80 to 5000 denier, tenacity of 12 g/d or more, and a maximum thermal shrinkage stress of 0.325 g/d or less, and the filaments include a polyethylene having a weight average molecular weight (Mw) of 50,000 to 600,000 g/mol.

According to another embodiment of the present disclosure, there is provided a method for manufacturing a polyethylene yarn, including:

(i) a preparation step of providing a melt for spinning containing a polyethylene having a weight average molecular weight (Mw) of 50,000 to 600,000 g/mol;

(ii) a spinning step of obtaining filaments by extruding the melt through a spinneret having 40 to 500 holes;

(iii) a quenching step of quenching the filaments;

(iv) a drawing step of multi-stage drawing a multifilament composed of the quenched filaments at a total draw ratio of 11 to 23 times using a multi-stage drawing zone including a plurality of godet rollers set at a temperature of 40 to 140° C.; and (v) a take-up step of taking up the multi-stage drawn multifilament, wherein the multifilament is directly in contact with the plurality of godet rollers to be drawn and thermally fixed in the drawing step.

Hereinafter, the polyethylene yarn and the method for manufacturing the same according to the exemplary embodiments of the present disclosure will be described in more detail.

The terms are used merely to refer to specific embodiments, and are not intended to restrict the present disclosure unless it is explicitly expressed.

Singular expressions of the present disclosure may include plural expressions unless they are differently expressed contextually.

The terms "include", "comprise", and the like of the present disclosure are used to specify certain features, regions, integers, steps, operations, elements, and/or components, and these do not exclude the existence or the addition of other certain features, regions, integers, steps, operations, elements, and/or components.

As a result of continuous research by the present inventors, it was confirmed that manufacturing a polyethylene yarn by the manufacturing method according to the present disclosure can prevent breakage of filaments during the spinning process and the drawing process, thereby ensuring high productivity. Further, it was also confirmed that it is possible to provide a polyethylene yarn having high tenacity comparable to polyethylene yarns manufactured by the conventional method and excellent dimensional stability with maximum thermal shrinkage stress of 0.325 g/d or less.

I. The Method for Manufacturing a Polyethylene Yarn

According to an embodiment of the present disclosure, there is provided a method for manufacturing a polyethylene yarn, including:

(i) a preparation step of providing a melt for spinning containing a polyethylene having a weight average molecular weight (Mw) of 50,000 to 600,000 g/mol;

(ii) a spinning step of obtaining filaments by extruding the melt through a spinneret having 40 to 500 holes;

(iii) a quenching step of quenching the filaments;

(iv) a drawing step of multi-stage drawing a multifilament composed of the quenched filaments at a total draw ratio of 11 to 23 times using a multi-stage drawing zone including a plurality of godet rollers set at a temperature of 40 to 140° C.; and (v) a take-up step of taking up the multi-stage drawn multifilament, wherein the multifilament is directly in contact with the plurality of godet rollers to be drawn and thermally fixed in the drawing step.

FIG. 1 is a simplified process diagram showing the manufacturing process of a polyethylene yarn according to an embodiment of the present disclosure.

Referring to FIG. 1, the method for manufacturing a polyethylene yarn may be performed by including a preparation step of providing a melt for spinning by feeding a raw material including a polyethylene resin into an extruder (100), extruding the melt through a spinneret (200) to obtain filaments (11), quenching the filaments (11) in a quenching zone (300), multi-stage drawing a multifilament (10) obtained by collecting the filaments (11) in a collecting zone (400) in a multi-stage drawing zone (500), and taking up the multi-stage drawn multifilament by a winder (600).

The method of manufacturing the polyethylene yarn according to an embodiment of the present disclosure is in accordance with a method in which the multifilament (undrawn yarn) obtained by melt spinning is continuously transferred to the multi-stage drawing zone without being separately taken up and then drawn, unlike the conventional method (so-called "two-step method") in which the undrawn yarn formed by melt spinning is once taken up and then drawn at a high draw ratio at high temperatures.

Hereinafter, each step that may be included in the method for manufacturing the polyethylene yarn will be described with reference to FIG. 1.

First, (i) a preparation step of providing a melt for spinning containing a polyethylene is performed.

The polyethylene may have a weight average molecular weight (Mw) of 50,000 to 600,000 g/mol.

In order to ensure appropriate tenacity of the yarn, the weight average molecular weight (Mw) of the polyethylene is preferably 50,000 g/mol or more. However, if the molecular weight of the polyethylene is too large, an overload may be applied to a spinning device due to a high melt viscosity and process control may become difficult, and accordingly, physical properties of the yarn may be poor. Therefore, it is preferable that the weight average molecular weight (Mw) of the polyethylene is 600,000 g/mol or less.

Preferably, the weight average molecular weight (Mw) of the polyethylene is 50,000 to 600,000 g/mol, 90,000 to 500,000 g/mol, 90,000 to 250,000 g/mol, 100,000 to 250,000 g/mol, 150,000 to 250,000 g/mol, 150,000 to 230,000 g/mol, or 170,000 to 230,000 g/mol.

The polyethylene may have a polydispersity index (PDI) of more than 5 and 9 or less.

In order to prevent the occurrence of breakage of filaments during spinning while securing appropriate tenacity of the yarn, the polyethylene preferably has a polydispersity index (PDI) of more than 5.0 and 9.0 or less, more than 5.0 and 8.0 or less, 5.5 to 7.5, or 6.0 to 7.5. If the PDI of the polyethylene is too small, flowability may be poor, and thus breakage of filaments may occur due to uneven discharge during melt extrusion. However, if the PDI of the polyethylene is too large, too much polyethylene having a low molecular weight may be included, resulting in poor drawability and making it difficult to achieve high tenacity.

Considering that the polydispersity index of the polyethylene may decrease in the following spinning step, the polyethylene having a polydispersity index that is slightly higher than the target polydispersity index (that is, the polydispersity index of the final yarn) may be used.

With respect to the polydispersity index, the melt should be extruded with a lower single-hole discharge rate in the method for manufacturing a polyethylene yarn according to an embodiment of the present disclosure than in the conventional two-step method.

That is, according to the conventional two-step method, it is possible to apply a relatively high single-hole discharge rate, so there is almost no fear of breakage of filaments during spinning. In addition, a polyethylene having a narrow molecular weight distribution (e.g., PDI of 4.0 or less) such that a total draw ratio of 20 times or more can be applied during the drawing process may be applied. This is because the drawing can be performed at a relatively higher draw ratio after obtaining relatively thick filaments in the conventional two-step method.

On the other hand, in the method of manufacturing a polyethylene yarn according to an embodiment of the present disclosure, the multifilament obtained by melt spinning is not separately taken up, but is continuously transferred to the multi-stage drawing zone to be drawn. Accordingly, in the method of manufacturing the polyethylene yarn, a relatively low single-hole discharge rate is applied, so that the filaments discharged from the spinneret (200) are much thinner, and thus the risk of breakage of filaments in the spinning process is inevitably high. For example, if a polyethylene having a PDI of 4.0 or less is applied to the above manufacturing method considering only excellent drawability, flowability is poor due to a narrow molecular weight distribution, and processability during melt extrusion becomes poor, thereby inevitably causing breakage of filaments due to uneven discharge during the spinning process.

For this reason, it is preferred that the polyethylene has a PDI of more than 5.0. However, if the PDI of the polyethylene is too large, too much polyethylene having a low molecular weight may be included, resulting in poor drawability and making it difficult to achieve high tenacity. Therefore, it is preferable that the polyethylene has a PDI of 9.0 or less.

In the present disclosure, the weight average molecular weight (Mw) and the polydispersity index (PDI) can be measured using gel permeation chromatography (GPC) under the following conditions after completely dissolving the polyethylene in a solvent.

Analyzer: PL-GPC 220 system

Column: 2×PLGEL MIXED-B (7.5×300 mm)

Solvent: Trichlorobenzene (TCB)+0.04 wt % dibutylhydroxytoluene (BHT, after drying with 0.1% $CaCl_2$))

Injector, detection temperature: 160° C.

Flow rate: 1.0 ml/min

Injection volume: 200 ul

Standard sample: Polystyrene

In addition, the polyethylene may have a melt index (MI, @190° C.) of 0.3 to 3 g/10 min.

In order to ensure appropriate flowability in the extruder (100), the melt index (MI, @190° C.) of the polyethylene is preferably 0.3 g/10 min or more. However, if the melt index of the polyethylene is too high, it may be difficult to achieve high tenacity due to a relatively low molecular weight. Therefore, it is preferable that the melt index (MI, @190° C.) of the polyethylene is 3.0 g/10 min or less.

Preferably, the melt index (MI, @190° C.) of the polyethylene may be 0.3 to 1.0 g/10 min, 0.3 to 0.8 g/10 min, 0.4 to 0.8 g/10 min, or 0.4 to 0.6 g/10 min.

Preferably, the polyethylene may have crystallinity of 65 to 85%.

In order to ensure physical properties of high tenacity and high elasticity, it is preferable that each of the polyethylene and the yarn has crystallinity of 65% or more. However, if the crystallinity is too large, it is difficult to control the temperature in the melt extrusion process, and thus processability may decrease. Therefore, it is preferable that the polyethylene and the yarn have crystallinity of 85% or less.

The crystallinity of the polyethylene and the yarn may be derived together with a crystallite size during analysis of the crystallinity using an X-ray diffractometer.

In addition, in order to prevent the occurrence of breakage of filaments during spinning while securing appropriate tenacity of the yarn, the polyethylene may preferably have a melting temperature ($T_m$) of 130 to 140° C.

Preferably, the polyethylene may have a density of 0.93 to 0.97 g/cm$^3$. If the polyethylene has a density within the above range, it may be advantageous in preventing the occurrence of breakage of filaments during spinning while securing appropriate tenacity of the yarn.

For example, the polyethylene may have a weight average molecular weight (Mw) of 50,000 to 600,000 g/mol and a polydispersity index (PDI) of more than 5 and 9 or less.

As another example, the polyethylene may have a weight average molecular weight (Mw) of 50,000 to 600,000 g/mol, a polydispersity index (PDI) of more than 5 and 9 or less, and a melt index (MI) of 0.3 to 3 g/10 min.

As another example, the polyethylene may have a weight average molecular weight (Mw) of 50,000 to 600,000 g/mol, a polydispersity index (PDI) of more than 5 and 9 or less, and crystallinity of 65 to 85%.

As another example, the polyethylene may have a weight average molecular weight (Mw) of 50,000 to 600,000 g/mol, a polydispersity index (PDI) of more than 5 and 9 or less, a melt index (MI) of 0.3 to 3 g/10 min, and crystallinity of 65 to 85%.

As another example, the polyethylene may have a weight average molecular weight (Mw) of 50,000 to 600,000 g/mol, a polydispersity index (PDI) of more than 5 and 9 or less, a melt index (MI) of 0.3 to 3 g/10 min, crystallinity of 65 to 85%, and a melting temperature ($T_m$) of 130 to 140° C.

As another example, the polyethylene may have a weight average molecular weight (Mw) of 50,000 to 600,000 g/mol, a polydispersity index (PDI) of more than 5 and 9 or less, a melt index (MI) of 0.3 to 3 g/10 min, crystallinity of 65 to 85%, a melting temperature ($T_m$) of 130 to 140° C., and a density of 0.93 to 0.97 g/cm$^3$.

Meanwhile, in order to prevent breakage of filaments in the subsequent spinning and drawing steps, a small amount of a fluorine-based polymer may be further contained in the melt for spinning.

According to an embodiment of the present disclosure, the fluorine-based polymer may be contained in an amount such that 50 to 2500 ppm, 100 to 2000 ppm, 200 to 1500 ppm, or 500 to 1000 ppm of fluorine is contained in the polyethylene yarn to be finally manufactured.

The content of the fluorine-based polymer may be measured using ion chromatography (IC) under the following conditions.

Analyzer: ICS-3000 (DIONEX)
Column: IonPac AS11 (4×250 mm)
Column temperature: 30.0° C.
Cell heater temperature: 35.0° C.
Flow rate: 1 ml/min
Suppressor type: ASRS 4 mm
Suppressor current: 100 mA
Eluent: Gradient (max. 20 mM)
Pre-treatment: Bomb method Preferably, the fluorine-based polymer may be at least one compound selected from the group consisting of polytetrafluoroethylene (PTFE), a tetrafluoroethylene-perfluoroalkyl vinyl ether copolymer (PFA), a tetrafluoroethylene-hexafluoropropylene copolymer (FEP), an ethylene-tetrafluoroethylene copolymer (ETFE), a tetrafluoroethylene-chlorotrifluoroethylene copolymer (TFE/CTFE), and ethylene-chlorotrifluoroethylene (ECTFE).

The fluorine-based polymer may be added to the extruder (100) in a state included in the master batch together with the polyethylene. Alternatively, while the polyethylene is added to the extruder (100), the fluorine-based polymer may be added through a side feeder (not shown) to be melted together.

Subsequently, (ii) a spinning step of obtaining filaments by extruding the melt through a spinneret having 40 to 500 holes or 100 to 500 holes is performed.

The melt is extruded through the spinneret (200) while being conveyed by a screw (not shown) in the extruder (100).

The spinning step is preferably performed at a temperature of 250 to 315° C., or 280 to 310° C.

In order to achieve formation of the uniform melt and stable spinning, the temperature inside the extruder (100) and the temperature of the spinneret (200) in the spinning step may preferably be 250° C. or more. However, if the temperature in the spinning step is too high, thermal decomposition of the melt may be caused, and thus it may be difficult to achieve high tenacity. Therefore, the temperature inside the extruder (100) and the temperature of the spinneret (200) may preferably be 315° C. or less in the spinning step.

L/D, which is a ratio of the hole length (L) to the hole diameter (D) in the spinneret (200), may be 3 to 40, 5 to 30, 5 to 20, or 10 to 20.

In order to prevent the occurrence of die swell during melt extrusion, the L/D may preferably be 3 or more. However, when the L/D is too large, uneven discharge due to pressure drop may occur along with breakage of filaments due to necking of the melt passing through the spinneret (200). Therefore, it is preferable that the L/D is 40 or less.

When the manufacturing method according to the present disclosure is performed continuously in consideration of processability and productivity, the spinning step is preferably performed such that the melt is extruded from the spinneret at a single-hole discharge rate of 0.05 to 0.45 g/min and a discharge linear velocity of 0.3 to 5.0 cm/s.

In the spinning step, if a spinning draft ratio ($DR=V_1/V_0$) is too large, many breakages of filaments may occur, resulting in poor processability, and if it is too small, orientation of crystallization may not be sufficiently performed, thus shape stability of the filament may be poor. Herein, $V_0$ is the discharge linear velocity of the melt (i.e., average velocity until the melt falls 1.25 m vertically from the holes of the spinneret (200)), and $V_1$ is the spinning velocity (i.e., linear velocity of the first godet roller (GR1)).

The higher the spinning velocity ($V_1$) is, the lower the total draw ratio in the drawing process is, and finally, it becomes difficult to improve the tenacity of the yarn. Therefore, in order to ensure an appropriate spinning draft ratio, the discharge linear velocity ($V_0$) is preferably 0.3 cm/s or more. However, since it is difficult to apply a high draw ratio when the discharge linear velocity is too large, the discharge linear velocity ($V_0$) is preferably 5.0 cm/s or less.

Specifically, the discharge linear velocity ($V_0$) may be 0.3 to 5.0 cm/s, 1.0 to 4.0 cm/s, or 2.0 to 3.0 cm/s.

In addition, in order to ensure 0.3 to 5.0 cm/s of the discharge linear velocity in the spinning step and satisfy 10 denier or less of a single yarn fineness, a relatively low single-hole discharge rate (for example, 0.05 to 0.45 g/min, 0.1 to 0.40 g/min, or 0.15 to 0.35 g/min) is preferably applied.

Thereafter, (iii) a quenching step of quenching the filaments is performed.

As the melt is discharged from the holes of the spinneret (200), the melt starts to solidify due to a difference between the spinning temperature and room temperature, thereby forming semi-solidified filaments. In this disclosure, both the semi-solidified filament and the fully-solidified filament are collectively referred to as "filament".

The plurality of filaments (11) formed while being discharged from the holes of the spinneret (200) are completely solidified by quenching in a quenching zone (300).

The quenching of the filaments may be performed by air quenching.

Preferably, the quenching step may be performed so that the temperature of the filament (11) is 15 to 40° C. using cooling air of 0.2 to 1.0 m/s.

In order to prevent the occurrence of breakage of filaments in the drawing process due to supercooling of the filaments, the filaments (11) are preferably quenched to 15° C. or more, 20° C. or more, or 25° C. or more. However, if the filaments are not sufficiently quenched, deviation of fineness increases due to uneven solidification, and breakage of filaments may occur in the drawing process. Therefore, the filaments (11) are preferably quenched to 40° C. or less, 35° C. or less, or 30° C. or less.

The quenched and completely solidified filaments are collected by a collecting zone (400) and provided as a multifilament (10).

Optionally, a step of applying an oil agent to the filaments using an oil roller (OR) or an oil jet may be further included, before forming the multifilament (10). The application of the oil agent may be performed in a metered oiling method. The application of the oil agent may be performed between godet rollers and/or between the last godet roller and a winder (600) in a subsequent drawing step.

Subsequently, (iv) a drawing step of multi-stage drawing a multifilament composed of the quenched filaments at a total draw ratio of 11 to 23 times using a multi-stage drawing zone including a plurality of godet rollers.

As described above, in the method of manufacturing a polyethylene yarn according to an embodiment of the present disclosure, the multifilament (10) obtained by melt spinning is not separately taken up, but is continuously transferred to the multi-stage drawing zone (500) including a plurality of godet rollers and then directly drawn. This manufacturing method according to an embodiment of the present disclosure is distinguished from a conventional two-step method in which the undrawn yarn formed by melt spinning is taken up once and then drawn at a high draw ratio at high temperatures.

A distance from the spinneret (200) to the multi-stage drawing zone (500) (specifically, a distance from the spinneret (200) to the first godet roller (GR1) of the multi-stage drawing zone (500)) is 140 to 550 cm, 200 to 500 cm, or 200 to 450 cm.

In order to allow proper quenching for the filaments (11), the distance is preferably 140 cm or more. However, if the distance is too far, it may be difficult to achieve high tenacity due to high spinning tension. Therefore, it is preferable that the distance is 550 cm or less.

In order for the finally obtained polyethylene yarn to have high tenacity, the drawing step should be precisely controlled using a multi-stage drawing zone (500) including a plurality of godet rollers.

To this end, it is preferable to perform the drawing step in the multi-stage drawing zone (500) including 3 or more, 3 to 30, 3 to 25, 5 to 25, or 5 to 20 godet rollers (GR1, . . . , GRn).

That is, performing the drawing step in a multi-stage drawing zone provided with three or more or five or more godet rollers is advantageous for obtaining a polyethylene yarn having excellent dimensional stability and high tenacity, considering that the multifilament obtained by melt spinning is not separately taken up, but is continuously transferred to the multi-stage drawing zone to be drawn in the above method of manufacturing a polyethylene yarn. However, if the number of godet rollers is too large in the multi-stage drawing zone, the polyethylene yarn finally obtained may not have target physical properties, or the overall efficiency of the process may decrease. Therefore, the drawing step is preferably performed in the multi-stage drawing zone provided with 30 or less, 25 or less, or 20 or less godet rollers.

In order to achieve sufficient drawing in the drawing step, the temperature of the plurality of godet rollers included in the multi-stage drawing zone (500) may be set at 40 to 140° C.

For example, the temperature of the first godet roller (GR1) among the plurality of godet rollers may be set at 40 to 80° C., and the temperature of the last godet roller (GRn) may be set at 110 to 140° C. The temperature of the godet rollers (GR2 to GRn−1) other than the first and last godet rollers (GR1, GRn) among the plurality of godet rollers may be set at a temperature equal to or higher than that of the godet roller located just before the corresponding godet roller. If necessary, the temperature of any godet roller may be set at a lower temperature than that of the preceding godet roller.

The total draw ratio of the multifilament in the multi-stage drawing zone (500) is a factor determined by the linear velocity (mpm) of the first godet roller (GR1) and the linear velocity (mpm) of the last godet roller (GRn). That is, the total draw ratio refers to a value obtained by dividing the linear velocity of the last godet roller (GRn) among the godet rollers provided in the multi-stage drawing zone (500) by the linear velocity of the first godet roller (GR1).

When the linear velocity of the first godet roller (GR1) is determined, the linear velocities of the other godet rollers may be determined such that a total draw ratio of 11 to 23 times can be applied to the multifilament (10) in the multi-stage drawing zone (500).

Through the drawing step, drawing and heat-setting are performed on the multifilament.

Unlike the method in which heat-setting is performed roughly using hot air, etc., the present disclosure performs the drawing step by directly contacting the multifilament with the plurality of godet rollers in the multi-stage drawing zone (500), thereby performing the heat-setting precisely. Accordingly, in the present disclosure, a polyethylene yarn having a low maximum thermal shrinkage stress of 0.325 g/d or less may be provided.

Thereafter, (v) a take-up step of taking up the multi-stage drawn multifilament is performed. The multifilament multi-stage drawn in the drawing step is taken up by a winder (600) to obtain a polyethylene yarn.

II. The Polyethylene Yarn

According to another embodiment of the present disclosure, there is provided a polyethylene yarn including 40 to 500 filaments having fineness of 10 denier or less, wherein the polyethylene yarn has total fineness of 80 to 5000 denier, tenacity of 12 g/d or more, and a maximum thermal shrinkage stress of 0.325 g/d or less, and the filaments include a polyethylene having a weight average molecular weight (Mw) of 50,000 to 600,000 g/mol.

Preferably, the polyethylene yarn can be manufactured by

I. The method for manufacturing a polyethylene yarn described above.

In particular, the polyethylene yarn may exhibit a maximum thermal shrinkage stress of 0.325 g/d or less while having tenacity of 12 g/d or more.

Preferably, the polyethylene yarn may have tenacity of 12 g/d or more, 12 to 20 g/d, 12 to 18 g/d, 12.5 to 18 g/d, or 12.5 to 16.5 g/d.

In addition, the polyethylene yarn may exhibit a maximum thermal shrinkage stress of 0.325 g/d or less, 0.200 to 0.325 g/d, or 0.250 to 0.325 g/d. In the present disclosure, the maximum thermal shrinkage stress can be measured using a thermal shrinkage stress tester (KANEBO KE-2, Shinkoh, DAS-4007 type, KANEBO Engineering, Korean agent: Eiko).

As described above, the polyethylene yarn of the present disclosure can exhibit high tenacity while having excellent dimensional stability.

The polyethylene yarn includes 40 to 500 filaments having fineness of 10 denier or less, 5 denier or less, or 2 denier or less, and may have total fineness of 80 to 5000 denier.

The polyethylene may have a weight average molecular weight (Mw) of 50,000 to 600,000 g/mol.

In order to ensure appropriate tenacity of the yarn, the weight average molecular weight (Mw) of the polyethylene is preferably 50,000 g/mol or more. However, if the molecular weight of the polyethylene is too large, an overload may be applied to a spinning device due to a high melt viscosity and process control may become difficult, and accordingly, physical properties of the yarn may be poor. Therefore, it is preferable that the weight average molecular weight (Mw) of the polyethylene is 600,000 g/mol or less.

Preferably, the weight average molecular weight (Mw) of the polyethylene is 50,000 to 600,000 g/mol, 90,000 to 500,000 g/mol, 90,000 to 250,000 g/mol, 100,000 to 250,000 g/mol, 150,000 to 250,000 g/mol, or 150,000 to 230,000 g/mol.

The polyethylene may have a polydispersity index (PDI) of more than 5 and 9 or less.

In order to prevent the occurrence of breakage of filaments during spinning while securing appropriate tenacity of the yarn, the polyethylene preferably has a polydispersity index (PDI) of more than 5.0 and 9.0 or less, more than 5.0 and 8.0 or less, 5.1 to 7.5, 5.5 to 7.5, or 6.0 to 7.5.

In addition, the polyethylene may have a melt index (MI, @190° C.) of 0.3 to 3 g/10 min. The polyethylene and the yarn may have crystallinity of 65 to 85%. The polyethylene may have a melting temperature ($T_m$) of 130 to 140° C. In addition, the polyethylene may have a density of 0.93 to 0.97 g/cm$^3$.

In order to ensure appropriate flowability in the extruder (100), the melt index (MI, @190° C.) of the polyethylene is preferably 0.3 g/10 min or more. However, if the melt index of the polyethylene is too high, it may be difficult to achieve high tenacity due to a relatively low molecular weight. Therefore, it is preferable that the melt index (MI, @190° C.) of the polyethylene is 3 g/10 min or less.

Preferably, the melt index (MI, @190° C.) of the polyethylene may be 0.3 to 3.0 g/10 min, 0.3 to 2.0 g/10 min, 0.4 to 1.5 g/10 min, or 0.4 to 1.0 g/10 min.

In order to ensure physical properties of high tenacity and high elasticity, it is preferable that the polyethylene has crystallinity of 65% or more. However, if the crystallinity is too large, it is difficult to control the temperature in the melt extrusion process, and thus processability may decrease. Therefore, it is preferable that the polyethylene has crystallinity of 85% or less.

In addition, in order to prevent the occurrence of breakage of filaments during spinning while securing appropriate tenacity of the yarn, the polyethylene may preferably have a melting temperature ($T_m$) of 130 to 140° C.

Preferably, the polyethylene may have a density of 0.93 to 0.97 g/cm$^3$. If the polyethylene has a density within the above range, it may be advantageous in preventing the occurrence of breakage of filaments during spinning while securing appropriate tenacity of the yarn.

Optionally, the filaments may further include a fluorine-based polymer together with the polyethylene.

According to an embodiment, the fluorine-based polymer may be contained in an amount such that 50 to 2500 ppm, 100 to 2000 ppm, 200 to 1500 ppm, or 500 to 1000 ppm of fluorine is contained in the polyethylene yarn to be finally manufactured.

Preferably, the fluorine-based polymer may be at least one compound selected from the group consisting of polytetrafluoroethylene (PTFE), a tetrafluoroethylene-perfluoroalkyl vinyl ether copolymer (PFA), a tetrafluoroethylene-hexafluoropropylene copolymer (FEP), an ethylene-tetrafluoroethylene copolymer (ETFE), a tetrafluoroethylene-chlorotrifluoroethylene copolymer (TFE/CTFE), and ethylene-chlorotrifluoroethylene (ECTFE).

The polyethylene yarn may have a crystallite size on a (110) plane of 120 Å or more, 120 to 190 Å, or 140 to 185 Å, when measured using the Scherrer equation from XRD data.

In addition, the polyethylene yarn may have a crystallite size on a (200) plane of 90 Å or more, 90 to 150 Å, or 95 to 135 Å, when measured using the Scherrer equation from XRD data.

As the polyethylene yarn has tenacity of 12 g/d or more and excellent dimensional stability by a low maximum thermal shrinkage stress, it can be applied to fields requiring excellent cut resistance and high tenacity.

For example, the polyethylene yarn can be used in the manufacture of string-shaped products such as ropes and fishing lines, industrial and medical protective gloves, protective covers, fishing nets, tents, helmets, tent materials, various sports goods, airbags, bedding, etc.

Advantageous Effects

In the present disclosure, there are provided a polyethylene yarn having excellent dimensional stability and high tenacity, and a method for manufacturing the above polyethylene yarn more efficiently.

BRIEF DESCRIPTION OF THE DRAWINGS

FIG. 1 is a simplified process diagram showing the manufacturing process of a polyethylene yarn according to an embodiment of the present disclosure.

FIG. 2 schematically shows a thermal shrinkage stress tester.

FIG. 3 is a graph showing a change in thermal shrinkage stress with respect to temperature measured for the polyethylene yarn prepared in Example 3.

FIG. 4 is a graph showing a change in thermal shrinkage stress with respect to temperature measured for the polyethylene yarn prepared in Comparative Example 1.

FIG. 5 is a graph showing a comparison of changes in thermal shrinkage stress with respect to temperature between the polyethylene yarns obtained in Example 2 (-■- indicated curve) and Comparative Example 3 (-●- indicated curve).

[DESCRIPTION OF SYMBOLS]

| | |
|---|---|
| 100: Extruder | 200: Spinneret |
| 300: Quenching zone | 11: Filament |
| 10: Multifilament | OR: Oil roller |
| 400: Collecting zone | 500: Multi-stage drawing zone |
| GR1: First godet roller | GRn: Last godet roller |
| 600: Winder | 700: Load cell |
| 800: Hot chamber | 900: Primary load hook |
| 1000: Yarn sample | |

DETAILED DESCRIPTION OF THE EMBODIMENTS

Hereinafter, the present invention will be described in more detail with the following preferred examples. However, these examples are for illustrative purposes only, and the invention is not intended to be limited by these examples.

Example 1

A polyethylene yarn including 200 filaments was manufactured using the apparatus illustrated in FIG. 1, wherein the polyethylene yarn has total fineness of 400 denier.

Specifically, polyethylene chips having a weight average molecular weight (Mw) of 200,000 g/mol, a polydispersity index (Mw/Mn: PDI) of 7.5, a melt index (MI, @190° C.) of 0.4 g/10 min, a melting temperature ($T_m$) of 132° C., and a density of 0.96 g/cm$^3$ were added to an extruder (100). At the same time, a tetrafluoroethylene copolymer was added to the extruder (100) through a side feeder. The tetrafluoroethylene copolymer was added in an amount such that the amount of fluorine detected in the final yarn is 500 ppm. A melt for spinning was prepared by melting the chips introduced into the extruder (100).

The melt was extruded through a spinneret (200) having 200 holes.

The filaments (11) formed while being discharged from the spinneret (200) were finally quenched to 40° C. by cooling air at 0.45 m/s in the quenching zone (300). The quenched filaments (11) were collected by a collecting zone (400) into a multifilament (10) and continuously transferred to a multi-stage drawing zone (500) provided with 12 godet rollers (GR1-GR12). Continuously, the multifilament (10) in the multi-stage drawing zone (500) directly contacted the 12 godet rollers, and was drawn at a total draw ratio of 16 times, followed by heat-setting. The temperature range of the godet rollers was set to 80 to 130° C.

A polyethylene yarn was obtained by taking up the multi-stage drawn multifilament on a winder (600).

Example 2

A polyethylene yarn was obtained in the same manner as in Example 1, except that the temperature range of the godet rollers in the multi-stage drawing zone (500) was set to 60 to 120° C.

Example 3

A polyethylene yarn was obtained in the same manner as in Example 1, except that polyethylene chips having a weight average molecular weight (Mw) of 170,000 g/mol, a polydispersity index (Mw/Mn: PDI) of 7.5, a melt index (MI, @190° C.) of 0.4 g/10 min, a melting temperature ($T_m$) of 132° C., and a density of 0.96 g/cm$^3$ were used.

Example 4

A polyethylene yarn was obtained in the same manner as in Example 1, except that the multifilament (10) in the multi-stage drawing zone (500) directly contacted the 12 godet rollers, and was drawn at a total draw ratio of 11 times, followed by heat-setting.

Example 5

A polyethylene yarn was obtained in the same manner as in Example 1, except that the multifilament (10) in the multi-stage drawing zone (500) directly contacted the 12 godet rollers, and was drawn at a total draw ratio of 23 times, followed by heat-setting.

Example 6

A polyethylene yarn was obtained in the same manner as in Example 1, except that polyethylene chips having a weight average molecular weight (Mw) of 200,000 g/mol, a melt index (MI, @190° C.) of 0.4 g/10 min, and a polydispersity index (Mw/Mn: PDI) of 4.5 were used.

Comparative Example 1

A polyethylene yarn was manufactured in a two-step method including a take-up step of taking up an undrawn polyethylene yarn formed by melt spinning and a drawing step of drawing the undrawn yarn with a hot air oven without using the apparatus illustrated in FIG. 1.

Specifically, polyethylene chips having a weight average molecular weight (Mw) of 200,000 g/mol, a melt index (MI, @190° C.) of 0.4 g/10 min, and a polydispersity index (Mw/Mn: PDI) of 4.5 were added to an extruder. At the same time, a tetrafluoroethylene copolymer was added to the extruder (100) through a side feeder. The tetrafluoroethylene copolymer was added in an amount such that the amount of fluorine detected in the final yarn is 500 ppm. A melt for spinning was prepared by melting the chips introduced into the extruder.

The melt was extruded through a spinneret (200) having 200 holes.

The filaments formed while being discharged from the spinneret were finally quenched to 40° C. by cooling air at 0.45 m/s in the quenching zone. The quenched filaments were collected by a collecting zone into a multifilament and taken up on a winder.

After moving the winder on which the multifilament was taken up to the place where a drawing machine was located, the multifilament taken up on the winder was drawn at a total draw ratio of 16 times, followed by heat-setting while heating with hot air of 80 to 130° C.

A polyethylene yarn having total fineness of 420 denier was obtained by taking up the drawn multifilament on a winder.

Comparative Example 2

A polyethylene yarn was obtained in the same manner as in Example 1, except that the temperature range of the godet rollers in the multi-stage drawing zone (500) was set to 60 to 150° C.

Comparative Example 3

A polyethylene yarn was obtained in the same manner as in Comparative Example 1 (that is, drawing and heat-setting using a hot air oven at 80 to 130° C.), except that polyethylene chips having a weight average molecular weight (Mw) of 200,000 g/mol, a polydispersity index (Mw/Mn: PDI) of 7.5, a melt index (MI, @190° C.) of 0.4 g/10 min, a melting temperature ($T_m$) of 132° C., and a density of 0.96 g/cm$^3$ were used.

Comparative Example 4

A polyethylene yarn was obtained in the same manner as in Example 1, except that the multifilament (10) in the multi-stage drawing zone (500) directly contacted the 12 godet rollers, and was drawn at a total draw ratio of 6 times, followed by heat-setting.

Comparative Example 5

A polyethylene yarn was obtained in the same manner as in Example 1, except that the multifilament (10) in the multi-stage drawing zone (500) directly contacted the 12 godet rollers, and was drawn at a total draw ratio of 25 times, followed by heat-setting.

Test Examples

Each of the polyethylene yarns prepared in examples and comparative examples was tested by the following method, and the results are shown in Tables 1 to 4 below.

(1) Tenacity of Polyethylene Yarn (g/d)

According to the standard test method of ASTM D885, the tenacity (g/d) of the polyethylene yarn was measured using a universal tensile tester manufactured by Instron Engineering Corp (Canton, Mass.). The sample was 250 mm long, a tensile velocity was 300 mm/min, and an initial load was set to 0.05 g/d.

(2) Mw, Mn, PDI

After completely dissolving filaments constituting the polyethylene yarn in the following solvent, a weight average molecular weight (Mw), a number average molecular weight (Mn), and a polydispersity index (Mw/Mn: PDI) were measured by gel permeation chromatography (GPC).

Analyzer: PL-GPC 220 system
Column: 2×PLGEL MIXED-B (7.5×300 mm)
Column temperature: 160° C.
Solvent: Trichlorobenzene (TCB)+0.04 wt % dibutylhydroxytoluene (BHT, after drying with 0.1% $CaCl_2$)
Dissolution conditions: 160° C., 1~4 hours, measuring the solution passed through a glass filter (0.7 μm) after dissolution
Temperature of injector, detector: 160° C.
Detector: RI Detector
Flow rate: 1.0 mℓ/min
Injection volume: 200 μℓ
Standard sample: Polystyrene (3) Crystallinity and Crystallite Size of Polyethylene Yarn The crystallinity and the crystallite size on the (110) plane and the (200) plane of the polyethylene yarn were measured by an X-ray diffractometer using X-rays. Specifically, the polyethylene yarn was cut to prepare a 2.5 cm sample, and the sample was fixed on a sample holder of the X-ray diffractometer, followed by measurement under the following conditions. When analyzing crystallinity by an X-ray diffractometer, the crystallinity (%) and the crystallite size (Å) are simultaneously derived.

i) Experimental equipment: Empyrean (Malvern Panalytical Ltd)
ii) X-ray source: Cu-Kα (1.54 Å), 45 kV, 20 mA
iii) Incident beam path
Filter: Beta-filter Nickel 0.02 mm
Slit: AS 1°, DS 1/2°, SS: 0.04 rad
Mask: 10 mm
iv) Diffracted beam path
Detector: PIXcel3D 2×2 (area detector)
Slit: AS 5.0 mm, SS: 0.04 rad
v) Scan range: 10°~32°
vi) Step size: 0.1°
vii) Beam direction: Reflection
viii) Background Method: Constant Background
ix) Standard Specimen: 3000 Denier
x) Apparent crystallite size (ACS): estimated from the half-height of the peak (110) plane and (200) plane using the Scherrer equation.

$$D = \frac{0.89\lambda}{\beta \cos\theta}$$

λ: X-ray wavelength, 0.154 nm
β: FWHM
Θ: Bragg angle (max. peak)
Scherrer constant K=0.89 xi) Crystallinity (Xc): Constant background method (4) Maximum Thermal Shrinkage Stress of Polyethylene Yarn (g/d)

The maximum thermal shrinkage stress of the polyethylene yarn was measured using a thermal shrinkage stress tester (KANEBO KE-2, Shinkoh, DAS-4007 type, KANEBO Engineering, Korean agent: Eiko).

As illustrated in FIG. 2, both ends of the polyethylene yarn were knotted to make a loop-shaped sample (1000) having a circumference of 10 cm. Both sides of the sample were placed in a hot chamber (800) of the thermal stress tester, and then hung on a load cell (700) and a primary load hook (900), respectively. The maximum thermal shrinkage stress was measured under the following conditions.

Experimental equipment: KE-2 (Kanebo Engineering Co., Ltd.)
Load cell: A load cell capable of measuring up to 500 gf Initial temperature: Room temperature
Heating rate: 300° C./120 s
Primary load: 0.06667 g/d The measurement result of the thermal shrinkage stress was obtained as a graph by an output device (Type 3086 X-T Recorder, Yokogawa, Hokushin Electric, Tokyo, Japan).

FIG. 3 is a graph showing a result of the experiment performed on the polyethylene yarn of Example 3, and it was confirmed that the maximum thermal shrinkage stress was about 115 g at about 150° C.

FIG. 4 is a graph showing a result of the experiment performed on the polyethylene yarn of Comparative Example 1, and it was confirmed that the maximum thermal shrinkage stress was about 145 g at about 150° C.

FIG. 5 is a graph showing a comparison of changes in thermal shrinkage stress with respect to temperature between the polyethylene yarns obtained in Example 2 (-■- indicated curve) and Comparative Example 3 (-●- indicated curve).

TABLE 1

| | | Example 1 | Example 2 | Example 3 |
|---|---|---|---|---|
| PE chip | PDI | 7.5 | 7.5 | 7.5 |
| | Mw (g/mol) | 200,000 | 200,000 | 170,000 |
| | Total draw ratio (times) | 16 | 16 | 16 |
| | Temperature range of godet rollers (° C.) | 80-130 | 60-120 | 80-130 |
| PE yarn | PDI | 5.6 | 5.6 | 5.6 |
| | Tenacity (g/d) | 14.5 | 14.1 | 13.1 |
| | Crystallinity (%) | 80 | 79 | 77 |
| | Crystallite size (Å) (110) plane | 161 | 165 | 183 |
| | Crystallite size (Å) (200) plane | 103 | 112 | 131 |
| | Max. thermal shrinkage stress (g/d) | 0.270 | 0.300 | 0.315 |

TABLE 2

| | | Example 4 | Example 5 | Example 6 |
|---|---|---|---|---|
| PE chip | PDI | 7.5 | 7.5 | 4.5 |
| | Mw (g/mol) | 200,000 | 200,000 | 200,000 |
| | Total draw ratio (times) | 11 | 23 | 16 |
| | Temperature range of godet rollers (° C.) | 80-130 | 80-130 | 80-130 |
| PE yarn | PDI | 5.6 | 5.6 | 3 |
| | Tenacity (g/d) | 12.5 | 16.3 | 16.3 |
| | Crystallinity (%) | 75 | 82 | 80 |
| | Crystallite size (Å) (110) plane | 173 | 145 | 150 |
| | Crystallite size (Å) (200) plane | 125 | 95 | 99 |
| | Max. thermal shrinkage stress (g/d) | 0.325 | 0.250 | 0.265 |

TABLE 3

| | | Comp. Example 1 | Comp. Example 2 | Comp. Example 3 |
|---|---|---|---|---|
| PE chip | PDI | 4.5 | 7.5 | 7.5 |
| | Mw (g/mol) | 200,000 | 200,000 | 200,000 |
| | Total draw ratio (times) | 16 | 16 | 16 |
| | Temperature range of godet rollers (° C.) | (hot air oven) 80-130 | 60-150 | (hot air oven) 80-130 |
| PE yarn | PDI | 3 | PE yarn could not be manufactured due to breakage during drawing | 5.6 |
| | Tenacity (g/d) | 16 | | 13.8 |
| | Crystallinity (%) | 78 | | 77 |
| | Crystallite size (Å) (110) plane | 155 | | 167 |
| | Crystallite size (Å) (200) plane | 97 | | 106 |
| | Max. thermal shrinkage stress (g/d) | 0.510 | | 0.525 |

TABLE 4

| | | Comp. Example 4 | Comp. Example 5 |
|---|---|---|---|
| PE chip | PDI | 7.5 | 7.5 |
| | Mw (g/mol) | 200,000 | 200,000 |
| | Total draw ratio (times) | 6 | 25 |
| | Temperature range of godet rollers (° C.) | 80-130 | 80-130 |
| PE yarn | PDI | 5.6 | PE yarn could not be manufactured due to breakage during drawing |
| | Tenacity (g/d) | 11.8 | |
| | Crystallinity (%) | 30 | |
| | Crystallite size (Å) (110) plane | 200 | |
| | Crystallite size (Å) (200) plane | 143 | |
| | Max. thermal shrinkage stress (g/d) | 0.345 | |

Referring to Tables 1 and 2, it was confirmed that the polyethylene yarns according to the examples had high tenacity compared to the polyethylene yarns according to the comparative examples, and low maximum thermal shrinkage stress, thereby exhibiting excellent dimensional stability. In addition, the polyethylene yarn could be obtained more efficiently without uneven discharge during spinning in the manufacturing method of the examples compared to the manufacturing method of the comparative examples.

The invention claimed is:

1. A polyethylene yarn comprising 40 to 500 filaments having fineness of 10 denier or less, wherein the polyethylene yarn has total fineness of 80 to 5000 denier, tenacity of 12.5 to 16.5 g/d, and a maximum thermal shrinkage stress of 0.250 to 0.325 g/d, and the filaments comprise a polyethylene made of polyethylene chips having a weight average molecular weight (Mw) of equal to or higher than 170,000 and lower than 180,000 g/mol, a polydispersity index (PDI) of 6.0 to 7.5, crystallinity of 65 to 85%, a melting temperature ($T_m$) of 130 to 140° C., a density of 0.93 to 0.97 g/cm$^3$, and a melt index (MI) of 0.4 to 0.6 g/10 min, wherein the filaments further contain a fluorine-based polymer in an amount such that the polyethylene yarn contains 500 to 1000 ppm of fluorine, wherein the polyethylene yarn has a crystallite size on a (110) plane of 120 to 190 Å and a crystallite size on a (200) plane of 90 to 150 Å, when measured using the Scherrer equation from XRD data.

2. The polyethylene yarn of claim 1, wherein the fluorine-based polymer comprises at least one selected from the group consisting of polytetrafluoroethylene (PTFE), a tetrafluoroethylene-perfluoroalkyl vinyl ether copolymer (PFA), a tetrafluoroethylene-hexafluoropropylene copolymer (FEP), an ethylene-tetrafluoroethylene copolymer (ETFE), a tetrafluoroethylene-chlorotrifluoroethylene copolymer (TFE/CTFE), and ethylene-chlorotrifluoroethylene (ECTFE).

3. A method for manufacturing a polyethylene yarn, comprising:

(i) a preparation step of providing a melt for spinning containing a polyethylene having a weight average molecular weight (Mw) of equal to or higher than 170,000 and lower than 180,00 g/mol, a polydispersity index (PDI) of 6.0 to 7.5, crystallinity of 65 to 85%, a melting temperature ($T_m$) of 130 to 140° C., a density of 0.93 to 0.97 g/cm$^3$, and a melt index (MI) of 0.4 to 0.6 g/10 min;

(ii) a spinning step of obtaining filaments by extruding the melt through a spinneret having 40 to 500 holes;

(iii) a quenching step of quenching the filaments;

(iv) a drawing step of multi-stage drawing a multifilament composed of the quenched filaments at a total draw ratio of 11 to 23 times using a multi-stage drawing zone comprising a plurality of godet rollers set at a temperature of 40 to 140° C.; and (v) a take-up step of taking up the multi-stage drawn multifilament, wherein the multifilament is continuously transferred to the multi-stage drawing zone without being separately taken up and then drawn, wherein the multifilament is directly in contact with the plurality of godet rollers to be drawn and thermally fixed in the drawing step, wherein the filaments further contain a fluorine-based polymer in an amount such that the polyethylene yarn contains 500 to 1000 ppm of fluorine.

4. The method for manufacturing a polyethylene yarn of claim 3, wherein the fluorine-based polymer comprises at least one selected from the group consisting of polytetrafluoroethylene (PTFE), a tetrafluoroethylene-perfluoroalkyl vinyl ether copolymer (PFA), a tetrafluoroethylene-hexafluoropropylene copolymer (FEP), an ethylene-tetrafluoroethylene copolymer (ETFE), a tetrafluoroethylene-chlorotrifluoroethylene copolymer (TFE/CTFE), and ethylene-chlorotrifluoroethylene (ECTFE).

5. The method for manufacturing a polyethylene yarn of claim 3, wherein the multi-stage drawing zone comprises 3 to 30 godet rollers.

* * * * *